US008472285B2

(12) United States Patent
Day

(10) Patent No.: US 8,472,285 B2
(45) Date of Patent: Jun. 25, 2013

(54) SUBMERSIBLE CHRONOGRAPH AND COUNTER

(76) Inventor: Lawrence James Day, Grand Blanc, MI (US)

( * ) Notice: Subject to any disclaimer, the term of this patent is extended or adjusted under 35 U.S.C. 154(b) by 264 days.

(21) Appl. No.: 12/944,811

(22) Filed: Nov. 12, 2010

(65) Prior Publication Data

US 2011/0280107 A1 Nov. 17, 2011

Related U.S. Application Data

(60) Provisional application No. 61/262,889, filed on Nov. 19, 2009.

(51) Int. Cl.
*G04F 10/00* (2006.01)

(52) U.S. Cl.
USPC ..... 368/107; 368/291

(58) Field of Classification Search
USPC ..... 368/291
See application file for complete search history.

(56) References Cited

U.S. PATENT DOCUMENTS

| | | | | |
|---|---|---|---|---|
| 3,784,768 | A | 1/1974 | Hunt | |
| 4,518,266 | A | 5/1985 | Dawley | |
| 5,130,955 | A * | 7/1992 | Luerker et al. | 368/3 |
| 5,136,621 | A | 8/1992 | Mitchell et al. | |
| 5,285,428 | A * | 2/1994 | Rosow et al. | 368/107 |
| 5,349,569 | A * | 9/1994 | Tanaka | 368/10 |
| 5,865,663 | A * | 2/1999 | Liao | 446/155 |
| 6,694,911 | B1 * | 2/2004 | Gallagher et al. | 114/315 |
| 6,870,466 | B2 * | 3/2005 | Rust et al. | 340/323 R |
| 6,940,784 | B1 | 9/2005 | Benson | |
| 7,029,170 | B2 * | 4/2006 | Bailey | 368/276 |
| 7,184,370 | B2 * | 2/2007 | Rogacki et al. | 368/107 |
| 7,234,703 | B1 * | 6/2007 | Kusz | 273/445 |
| 7,665,888 | B2 * | 2/2010 | Weinstein et al. | 368/276 |
| 7,753,754 | B2 * | 7/2010 | Curtis et al. | 446/153 |
| 2005/0135193 | A1 * | 6/2005 | Kaski | 368/10 |

* cited by examiner

*Primary Examiner* — Renee Luebke
*Assistant Examiner* — Jason Collins
(74) *Attorney, Agent, or Firm* — Young Basile

(57) ABSTRACT

A submersible device for keeping track of a swimmer's session transpired times. It includes a case which is pivotally adjustable in relation to a base, and which contains both a watertight and a ballast compartment to decrease the buoyancy of the device when in use in water. The device may include a lap counter and a proximity sensor activated by the proximity of a swimmer wearing a proximity transmitter. A high contrast liquid crystal display is used to improve visibility.

11 Claims, 5 Drawing Sheets

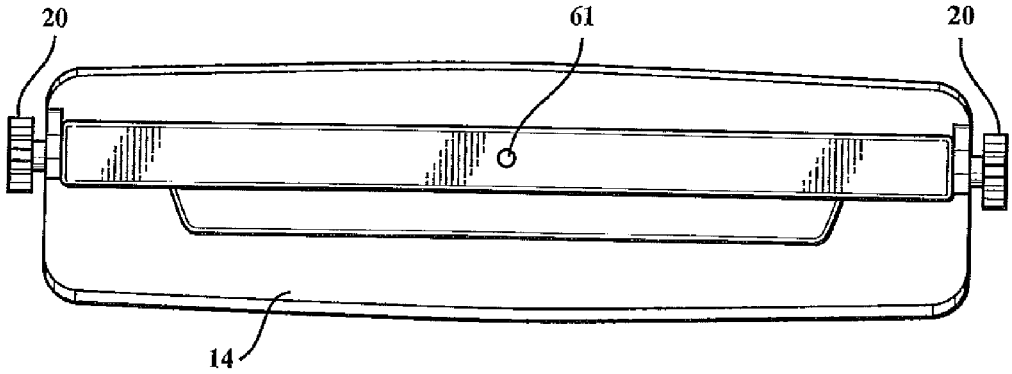
FIG. 6
FIG. 7
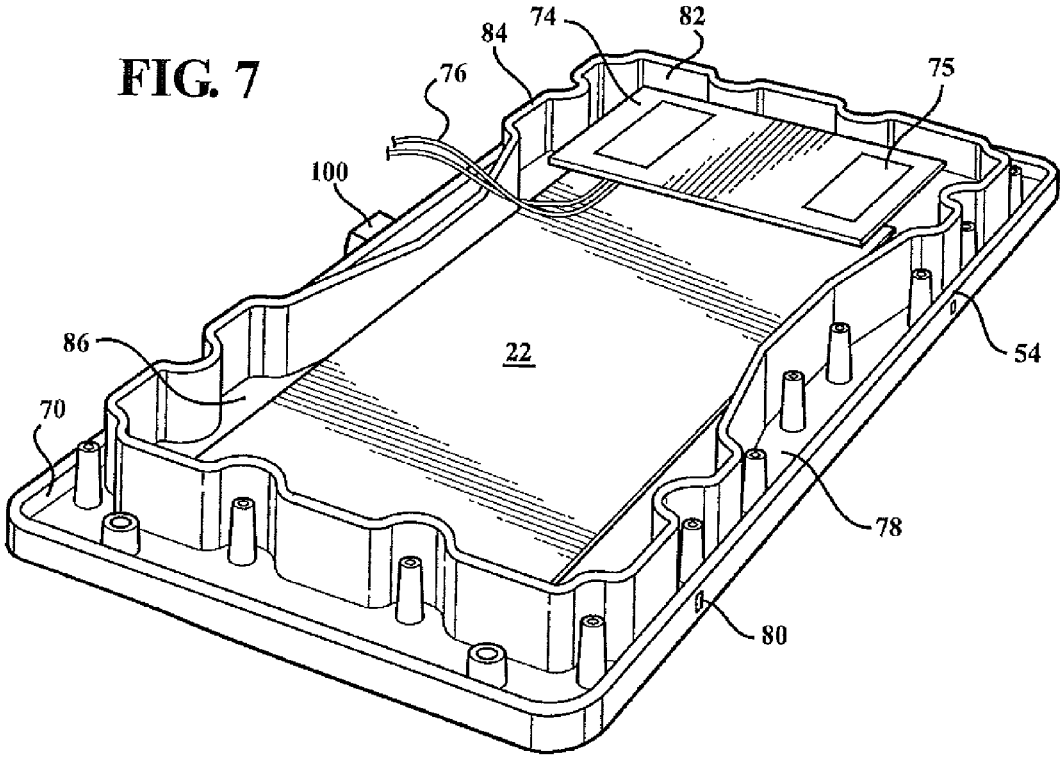

SUBMERSIBLE CHRONOGRAPH AND COUNTER

CROSS-REFERENCE TO RELATED APPLICATIONS

This application is related to, and claims the benefit of priority from U.S. Provisional Patent Application Ser. No. 61/262,889, filed Nov. 19, 2009.

FIELD OF THE INVENTION

The present invention pertains to submersible timing and lap-counting devices for use by swimmers, and more particularly, to such devices utilizing high contrast displays with integral ballast systems.

BACKGROUND

For competitive swimmers, as well as for recreational lap swimmers, it is desirable to accurately time each lap, being one transit of the length of the pool and return. Each out and back lap typically occurs within the confines of a marked swimming lane, with the swimmer returning to the starting point in his or her lane at the beginning of each lap.

Swimmers desire the ability to measure the elapse time for each lap. As a result of this need, a variety of timers and lap counters for swimmers have been developed.

For example, U.S. Pat. No. 7,029,170, issued to Bailey, teaches a swim lap counter-timer adapted to be affixed to the deck and wall of a swimming pool, and featuring a submersible timer and lap counter together with a pressure-sensitive switch which allows activation of both the counter and the timer. A similar device is taught by Dawley in U.S. Pat. No. 4,518,266, in the form of a timer and lap counter which is secured to a stationary object on the pool deck, or to a heavy weight. In this device, the electronic display is maintained above the surface of the water, and an activation kick pad is mounted below the water surface. A similar device is taught by Benson in U.S. Pat. No. 6,940,784. This digital display device is operable to display both a chronograph and a lap timer in a hand-held case, which is designed to be immersed in water. Further refinements are taught in U.S. Pat. No. 5,136,621, to Mitchell, et al., in which the lap timer/counter is activated by an ultrasonic transmitter worn by the swimmer.

All of the foregoing devices exhibit common limitations. First, the devices often exhibit insufficient reflectivity, by virtue of the fact that they utilize liquid crystal displays which require illumination to provide sufficient contrast, or require LED displays.

Further, the display units are in a fixed relationship to the case which is utilized for positioning the device to the pool wall or pool bottom. Because of the refractive index of water, the fixed position of the display in relation to its case may render the display difficult to observe depending on the swimmer's position in relation to the device.

Prior art devices have also exhibited known problems with buoyancy. It is desirable to be able to position the timer/counter at varying depths, and all known devices do not allow for buoyancy control.

One object of the invention, therefore, is to provide a lap timer for use by swimmers which has an extremely high contrast yet low power consumption liquid crystal display.

It is another object of the present invention to provide a swimmer's lap timer which is angularly adjustable in relation to the swimmer's line of sight in the water to provide an easily readable display.

Another object of the present invention is to provide for variable buoyancy of the swimmer's timer so that the timer remains stable in relation to the swimmer's lane at any of a variety of depths.

Another object of the present invention is to provide a swimmer's timer which can be mounted to a base, to the pool deck, or to the pool wall.

A further object of the present invention is to provide a swimmer's timer which is selectively operable as either a timer which is manually operated, or a timer which is operated by a sensing system which operates effectively under the surface of the water.

These and other objects of the present invention will be more fully appreciated from the following summary and description.

SUMMARY OF THE INVENTION

The submersible timer comprises a high contrast display contained within a waterproof housing. The housing is pivotally connected to a weighted bracket which may be mounted on the pool deck, the pool wall or the pool floor. One or more magnetic sensors may be associated with the display to sense the position of a magnetic device carried by a swimmer and moving in proximity to the timer.

A ballast chamber is provided within the case to permit a predetermined volume of water to enter the ballast chamber and thereby provide a more secure positioning of the timer in relation to the floor of the pool. When not in use, the ballast chamber can be emptied, resulting in a display which is relatively light in weight.

BRIEF DESCRIPTION OF THE DRAWINGS

The description herein makes reference to the accompanying drawings wherein like reference numerals refer to like parts throughout the several views, and wherein:

FIG. 6 is a top view of the lap timer.

FIG. 7 is a perspective view of the interior of the timer showing the ballast chamber and other internal components.

DETAILED DESCRIPTION OF THE EMBODIMENT

Figure 1:
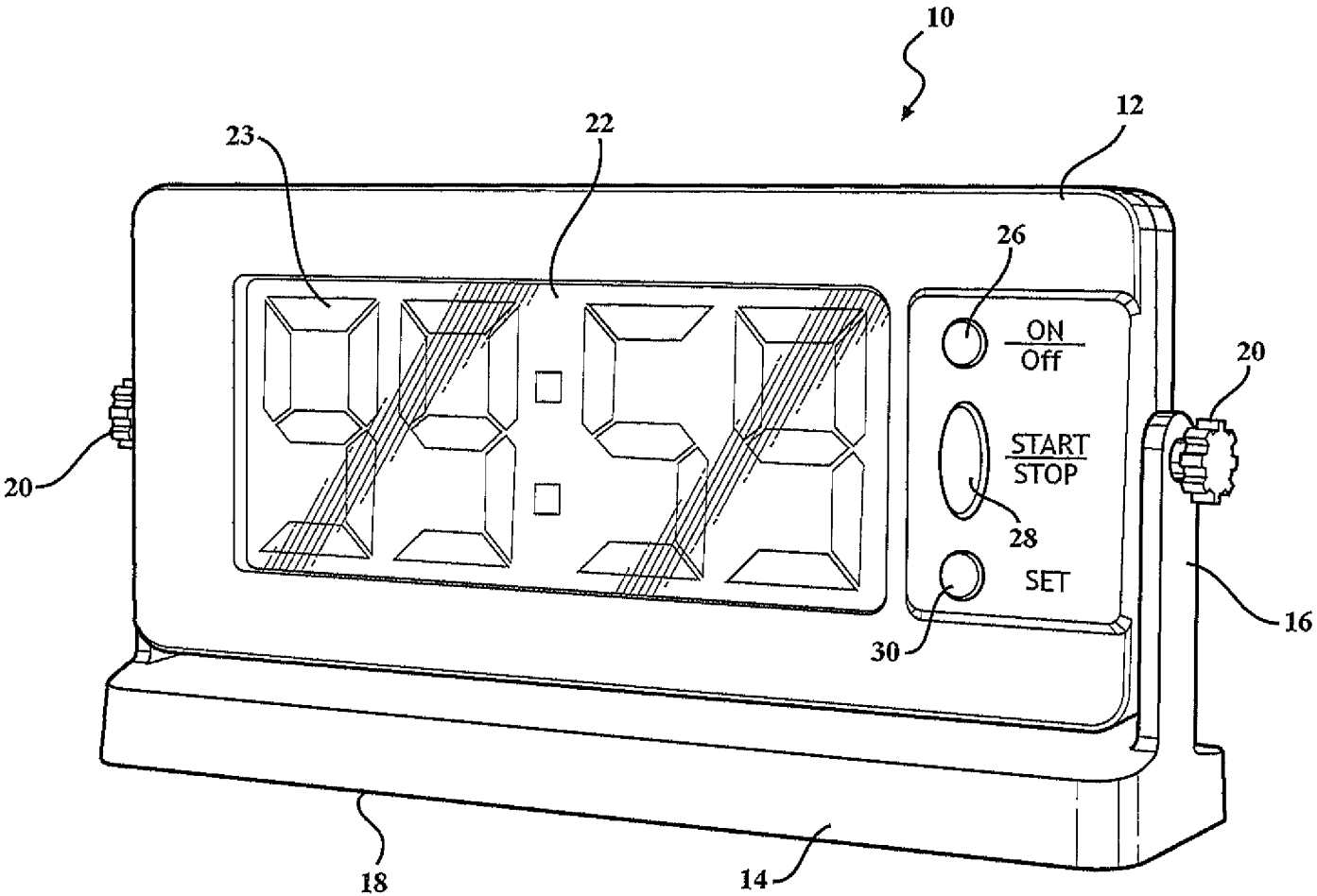
FIG. 1 is a perspective view of an exemplary submersible swim lap timer.

The following description will be best understood by reference to the drawings above described. The present invention is a timer 10 incorporating a case 12, a base 14 and a digital display 22. The digital display 22 is secured within the case 12, and the case 12 with its associated window 34 and operating controls including an on/off switch 26, a start/stop switch 28 and a reset switch 30 are constructed as a watertight unit, so that the digital display 22 and its associated electronic circuitry are not damaged or rendered inoperative by exposure to water.

Figure 8:
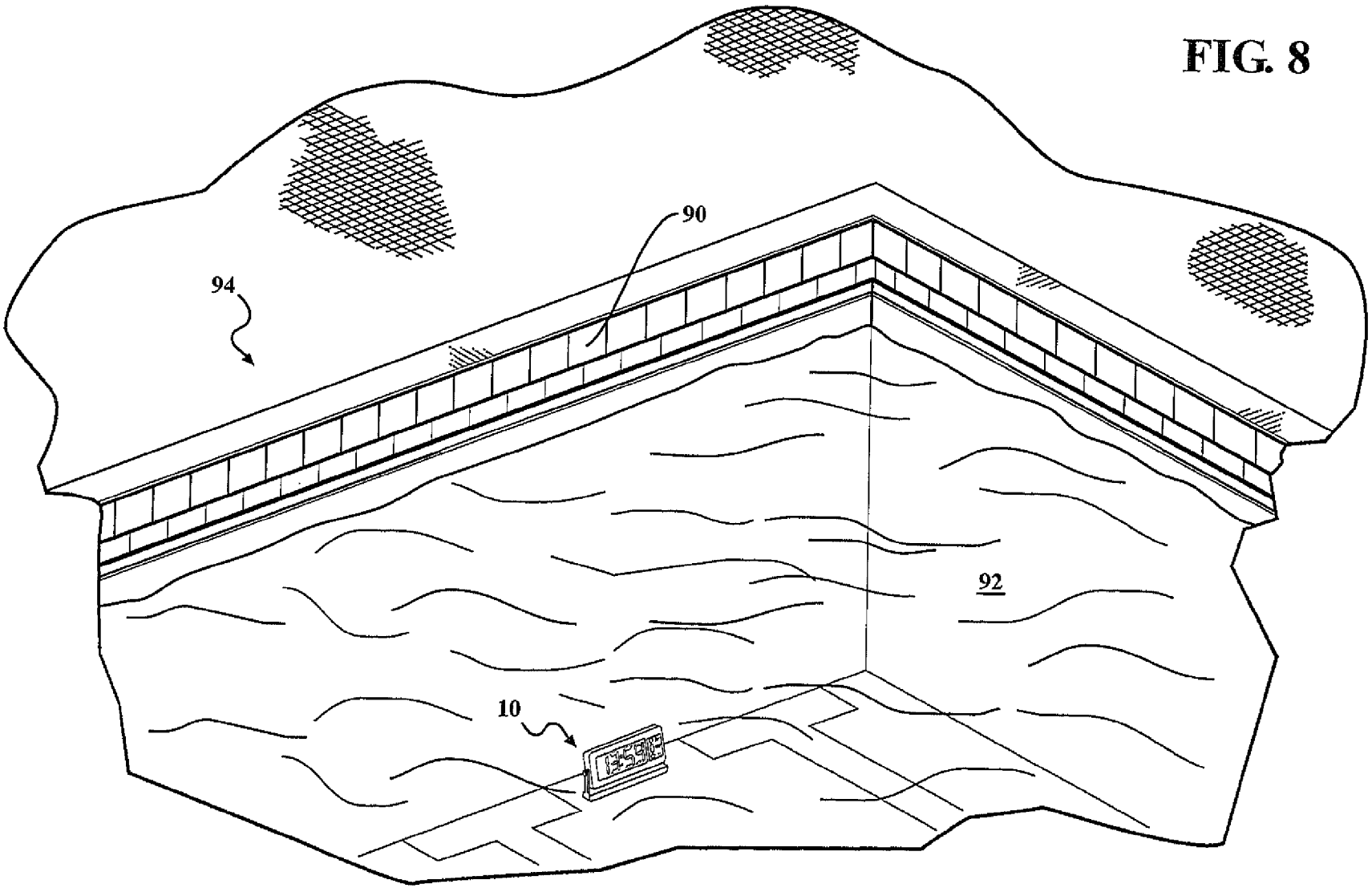
FIG. 8 is an environmental, perspective view of the swim lap timer in use.

The basic configuration of the timer 10 as depicted in FIG. 1 and FIG. 8. The case 12 is pivotally secured to base 14 by a pair of brackets 16 which are provided with thumb screws 20 which engage threaded sockets (not shown) in the sides of the case 12. In this fashion, the case 12 may be rotated in relation to base 14 to vary the angle between the case 12 and the base 14, thereby allowing the user of the timer 10 to position the digital display 22 in relation to the surface on which base 14 is placed so that a digital display 22 is readily visible to a swimmer using the device.

In the described embodiment, base 14 contains a weight 18, which may be formed integrally with base 14 or may be a separate element positioned within the interior of base 14. Preferably, weight 18 is treated to minimize deterioration and rusting, while still providing substantial mass to stabilize the base 14 in relation to the surface of the bottom of a swimming pool. Thumbscrews 20 may be of the wing nut style, or of a knurled knob style, or any other easily adjustable thumbscrew which will allow the friction between the sides of case 12 and the bracket 16 to be varied as needed.

Figure 2:
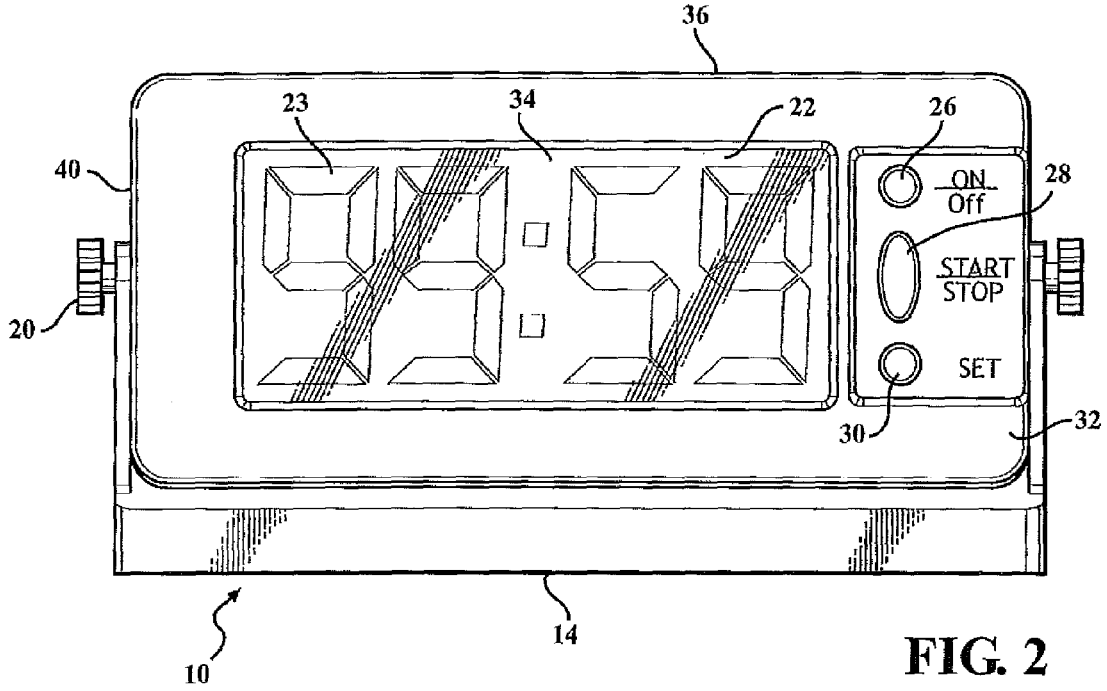
FIG. 2 is a front view of the timer.
Figure 3:
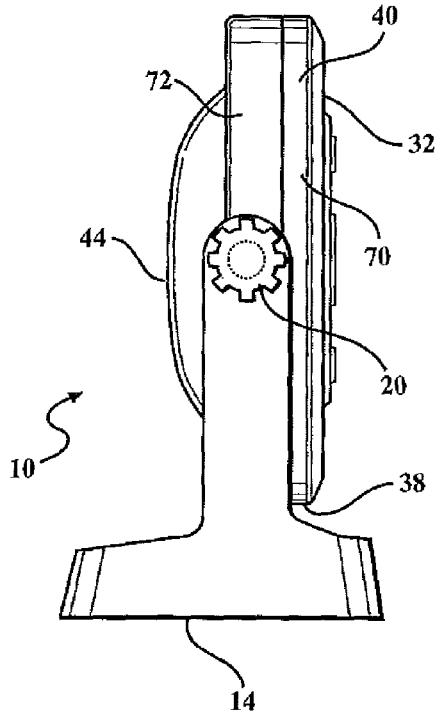
FIG. 3 is a side view of the swim lap timer.
Figure 4:
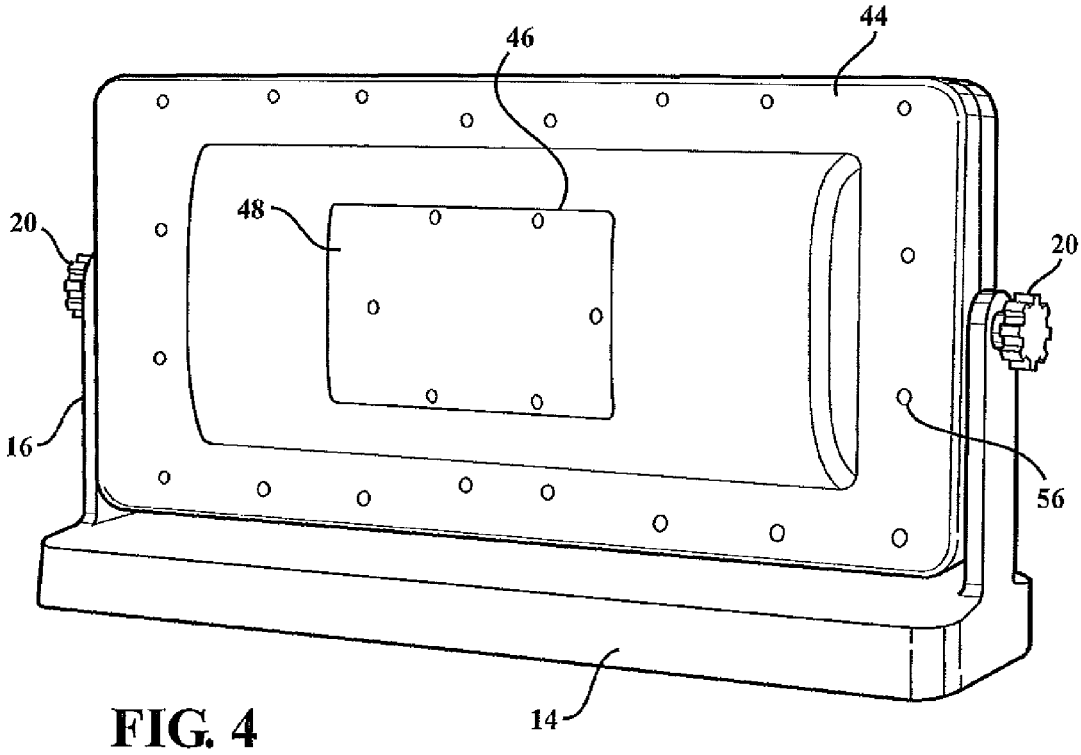
FIG. 4 is a back perspective view of the lap timer.
Figure 5:
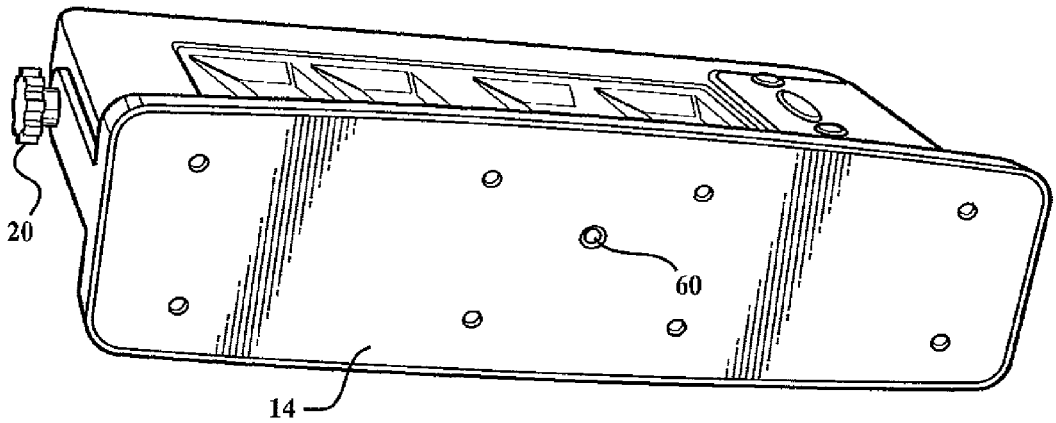
FIG. 5 is a bottom perspective view of the lap timer.

Further as shown in FIGS. 1 and 2, digital display 22 consists of a high resolution, high contrast liquid crystal display. The digital display 22 is driven by electronic circuitry 75 in the form of a dedicated integrated circuit containing both the chronograph timing circuitry, control circuitry, and the display driver circuitry. Such digital circuits are widely available and well known in the art. The timer of the present invention is a simple count up timer, preferably as showing minutes and seconds only, with a flashing colon between the minutes and seconds to alert the user to the fact that the timer is in operation. The timer utilizes only three controls, all positioned on an operative console 24 on the face of the case 12 so that they can be easily operated by the swimmer if desired. The first control is the on/off switch 26, which, when operated, toggles the timer 10 between a powered on and a powered off mode. The second operating control is the start stop switch 28, which is characterized in that it is a larger physical size than the remaining switches, since it is the switch which will be most frequently used by the swimmer when the clock is in operation. The start/stop switch 28, as its name suggests, starts and stops the operation of the timer. In the start mode, the timer is running, and the minutes and seconds increment. When the start/stop switch 28 is toggled to the stop position, the elapsed time remains visible on the display, but the timer is not running. In this fashion, the time elapsed for each consecutive lap may be measured separately. The final control is the reset switch 30, which, as its name suggests, resets the timer to zero.

As shown in FIGS. 1-7, the case 12 of timer 10 comprises a case front half 70, a case rear half 72, and a window 34. The case rear half 72 is provided a battery compartment 46, which is provided with a battery compartment cover 48 secured to the case rear half 72 by a plurality of fasteners 56. Interposed between the case rear half 72 and the battery compartment cover 48 is a seal (not shown), which provides a watertight seal between the battery compartment cover 48 and the case rear half 72. The batteries utilized in the present embodiment are in the form of AAA batteries, which have been proven to provide the necessary longevity and affordability required for devices of this type. However, it will be obvious to those skilled in the art that a variety of different batteries may be utilized to achieve the result of supplying the necessary power to the electronic circuitry. In addition to batteries of the afore described type, it will also be appreciated that rechargeable batteries may be used, including rechargeable batteries which are capable of being recharged through an induction system, thereby insuring the water tight integrity of the case 12 by eliminating the battery compartment cover 48.

The rear half 72 is secured to the case front half 70 utilizing a plurality of fasteners 56 spaced around the approximate perimeter case halves. Interposed between the case front half 70 and the case rear half 72 is a seal 54 as depicted in FIG. 7. Preferably the seal is the form of a flexible O-ring or comparable resilient member which, when compressed, prevents the uncontrolled entry of water into the interior of the case, except to enter the ballast chamber 78 as will be further described herein.

The case 12 is provided with threaded sockets 61 in the top and in the bottom (socket not shown), to allow the case 12 to be mounted utilizing a threaded fastener to a portion of the pool wall or pool floor on which the device is to be used, when it is desired to use the device without the base 14 and bracket 16. Further, base 14 is provided with a threaded socket, to permit the entire assembly to be mounted to a threaded fastener, thereby permitting the assembly to be mounted to a pool wall or pool floor. Further, the threaded sockets 61, as well as both the base 14 and bracket 16 may be utilized to secure a flexible suspension element, such as a rope, to the timer to permit the timer to be suspended from a lane line or lane line securement point on the wall of the swimming pool.

To insure that the timer 10 remains stable when placed on a horizontal surface such as the pool floor, it is desirable that as little air as possible remain within the interior of the case 12. In the embodiment, a portion of the interior of the case 12 is formed as a ballast chamber 78 as shown in FIG. 7. A ballast chamber wall 82 surrounds the digital display 22. The ballast chamber wall is sealed against the ingress of water to the interior of the case front half 70. The upper surface of the ballast chamber wall 82 is provided with a seal 84, again in the form of a flexible element which engages the upper surface of the ballast chamber wall 82, and the inner surface of the case rear half 72, thereby providing a water-tight seal which surrounds the digital display 22 and a circuit board 74 containing electronic circuitry 75. The ballast chamber wall 82 is preferably formed of a rigid thermoplastic material, and, when viewed from above, presents a scalloped appearance. The scalloped configuration of the ballast chamber wall serves to spread the compression loads placed on the ballast chamber wall 82 when the case front half 70 and case rear half 72 are secured together by fasteners. This geometry of the ballast chamber wall provides the necessary rigidity to withstand the compression loads placed on the device when the case is secured in the assembled condition. To permit the ingress and egress of water into the ballast chamber 78, a plurality of ballast ports 80 are provided around the perimeter of the case front half 70. In this fashion, as the case 12 and base 14 are immersed in water, water flows into the ballast chamber 78 thereby substantially reducing the buoyancy of the timer 10, so that the timer 10 resists movement in relationship to the movement of the water. Likewise, the provision of the sealed ballast chamber 78 and ballast chamber wall 82 creates a sealed compartment 86 in which the liquid crystal digital display 22 is secured, together with circuit board 74 and its associated electronic circuitry 75, as well as electrical conductors 76 which interconnect the circuit board 74 with the battery compartment 46. By using this dual chamber configuration, the electrical components, including the batteries, of the timer 10 are contained in an airtight chamber which is surrounded by water in the ballast chamber 78.

A further advantage of this configuration is the fact that upon removal of the timer 10 from the water, the water drains from the ballast ports 80 thereby making the entire assembly lighter and more easily transportable.

In use, the timer 10 is preferably placed on the floor 92 of a swimming pool 94 having perimeter walls 90. As the timer 10 is immersed in the water, the air contained within the ballast chamber 78 is displaced, and water fills the chamber, thereby reducing the buoyancy of the timer 10. The weight of the remaining components of the timer 10, as well as the weight of the base 14, encourages the timer 10 to rest securely on the floor 92 of the swimming pool 94. Operation of the timer 10 is commenced by operation of the on/off switch 26 and the start/stop switch 28, and the timer may be reset by operation of the reset switch 30. The operator may choose to simply allow the timer to run over a session of multiple laps, or may elect to stop reset and start the timer at the end of each lap.

In another embodiment of the present invention, a sensor 100 is attached to the case 12 and electronically connected to the electronic circuitry 75. In this embodiment, the sensor 100 is a magnetic sensor, which is designed to sense the presence of an external magnetic field. A swimmer wears a magnetic transmitting device (not shown) on the his/her's person. As the swimmer approaches the sensor 100, the sensor 100 senses the presence of the magnetic device carried by the swimmer and sends a signal to the electronic circuitry 75 which results in the electronic circuitry incrementing a lap counter, storing an elapsed lap time, and resetting the digital display to zero for the next lap. In this embodiment, the display may incorporate multiple display elements, including an accumulating timer showing the entire elapsed time of a multiple lap event, as well as the individual time for each lap. Magnetic sensors are preferable to other types of sensors which have been attempted in similar applications, such as radio frequency sensors, inasmuch as radio frequency sensors signals may be attenuated by immersion in water.

What is disclosed, therefore, is a simple yet reliable timing device for the use by swimmers to track elapsed times during practice and for races or other events, and which is appropriately non-buoyant when immersed in water and which maintains a secure position in relation to the swimming pool in which the device is used, while at the same time being portable and relatively lightweight when not in use and removed from the water.

The present invention is not limited to the embodiments described above, but encompasses any and all embodiments within the scope of the following claims.

I claim:

1. An apparatus for timing swim laps comprising:

a case having a front portion, a rear portion, and a ballast chamber wall that extends from the front portion to the rear portion to define a closed perimeter;

a resettable electronic chronograph contained within said case;

an electronic digital display operated by said chronograph, whereby said chronograph displays at least one elapsed time as measured by said chronograph;

a water tight compartment enclosing said chronograph, wherein the water tight compartment is disposed within said closed perimeter defined by said ballast chamber wall;

a weight; and a ballast compartment adjacent to and surrounding said water tight compartment, wherein said ballast compartment includes holes that passively permit ingress and egress of water.

2. The apparatus of claim 1, further comprising a lap counter circuit, whereby a swimmer's laps are counted and displayed.

3. The apparatus of claim 2, further comprising a weighted base pivotally supporting said case, wherein said case may be pivoted in relation to said base, said base is adapted to be submerged in a swimming pool and positioned on a pool floor of said swimming pool, and said base includes brackets that extend upward therefrom for pivotally supporting said case.

4. The apparatus of claim 2, which further comprises a magnetic sensor for sensing proximity of a magnetic transmitting device worn by a swimmer to said chronograph.

5. The apparatus of claim 1, further comprising a weighted base pivotally supporting said case, wherein said case may be pivoted in relation to said base, said base is adapted to be submerged in a swimming pool and positioned on a pool floor of said swimming pool, and said base includes brackets that extend upward therefrom for pivotally supporting said case.

6. The apparatus of claim 1, wherein said ballast compartment surrounds the ballast chamber wall and the water tight compartment.

7. The apparatus of claim 1, which further comprises sensor means for sensing proximity of a swimmer to said chronograph.

8. A submersible timer that is positionable on a pool floor of a swimming pool for use by swimmers, the submersible timer comprising:

a base having a bottom surface that is engageable with the pool floor, a top surface, a first bracket that extends upward from the top surface at a first end of the base, and a second bracket that extends upward from the top surface at a second end of the base;

a case having a front portion, a rear portion, a peripheral wall defined by the front portion and the rear portion, and a ballast chamber wall that is disposed inward from the peripheral wall and extends from the front portion to the rear portion, wherein a ballast chamber is defined between the ballast chamber wall and the peripheral wall, one or more ballast ports are formed in the case to passively permit ingress and egress of water into and out of the ballast chamber, a sealed chamber is defined inward of the ballast chamber wall between the front portion and the rear portion and is sealed against ingress and egress of water, and the case is positioned between and pivotally mounted to the first bracket and the second bracket of the base;

a resettable electronic timer disposed within the sealed chamber of the case for measuring at least one elapsed time; and an electronic digital display operated by the resettable electronic timer, wherein the resettable electronic timer displays the at least one elapsed time.

9. The submersible timer of claim 8, wherein the ballast chamber extends continuously around the ballast chamber wall.

10. The submersible timer of claim 8, wherein the ballast chamber extends co-extensively with the peripheral wall.

11. The submersible timer of claim 8, wherein the ballast chamber wall is formed as an integral portion of one of the front portion of the case or the rear portion of the case, and a sealing member is provided to seal the ballast chamber wall with respect to the other of the front portion of the case or the rear portion of the case.

* * * * *